United States Patent [19]

Samuelson

[11] 4,113,553

[45] Sep. 12, 1978

[54] SODIUM SULFIDE PULPING WITH HYDROGEN SULFIDE GENERATION

[75] Inventor: Hans Olof Samuelson, Gothenburg, Sweden

[73] Assignee: Mo Och Domsjo Aktiebolag, Ornskoldsvik, Sweden

[21] Appl. No.: 763,203

[22] Filed: Jan. 27, 1977

[30] Foreign Application Priority Data

Feb. 5, 1976 [SE] Sweden ..... 7601284

[51] Int. Cl.[2] ..... D21C 3/02; D21C 11/12

[52] U.S. Cl. ..... 162/34; 162/35; 162/38; 162/82; 162/90; 423/573 R; 423/DIG. 3

[58] Field of Search ..... 162/29, 30 R, 30 K, 162/34, 35, 38, 82, 86, 90; 423/562, 573 R, 573 G, DIG. 3

[56] References Cited

U.S. PATENT DOCUMENTS

| | | | |
|---|---|---|---|
| 2,854,334 | 9/1958 | Knapp et al. | 162/82 |
| 3,192,102 | 6/1965 | Nolan | 162/82 X |
| 3,210,235 | 10/1965 | Ferrigan et al. | 162/82 X |
| 3,331,733 | 7/1967 | Venemark | 423/562 X |
| 3,347,739 | 10/1967 | Tomlinson | 162/82 X |
| 3,560,329 | 2/1971 | Nelson et al. | 162/82 X |
| 3,811,995 | 5/1974 | Ringley | 162/82 X |
| 3,841,962 | 10/1974 | Procter et al. | 162/82 X |
| 3,874,991 | 4/1975 | Kleppe | 162/82 X |

*Primary Examiner*—Arthur L. Corbin

[57] ABSTRACT

A process for pulping hardwood to produce cellulose pulp in good yield and of high quality, with a low requirement for causticized pulping liquor, which comprises in a first pulping stage pulping the hardwood in an alkaline pulping liquor containing sodium sulfide at a pH of about 10.5 to about 13 and at a temperature within the range from about 110° to about 170° C while generating hydrogen sulfide in situ by reaction of sodium sulfide with organic acids liberated in the pulping; and then in a second pulping stage, following directly after the first pulping stage, continuing the pulping at a pH higher than said first stage pH, within the range of about 12.5 to about 14 and at a temperature higher than said first stage temperature within the range from about 145° to about 190° C, in the presence of added alkaline pulping liquor comprising sodium hydroxide and sodium sulfide until cellulose pulp is produced.

23 Claims, No Drawings

SODIUM SULFIDE PULPING WITH HYDROGEN SULFIDE GENERATION

Andersson, Bergstrom and Hartler, Swedish Pat. No. 309,530, suggest that the pulp yield in the sulfate pulping of softwood can be increased considerably if the digestion is carried out in two stages. First, the wood is subjected to pretreatment with a sodium hydrosulfide solution at elevated temperature, and then the wood is pulped using a pulping liquor containing sodium hydroxide and sodium sulfide. However, sodium hydrosulfide solution has a high partial pressure of hydrogen sulfide, especially at elevated temperatures, and consequently, because of the toxicity of hydrogen sulfide, the preparation and handling of sodium hydrosulfide solutions in a pulp mill pose very difficult problems, particularly from the standpoint of safety. Consequently, this process has not been applied on a commercial scale.

Day and Hoos, Swedish Pat. No. 167,779, suggest that the yield of cellulose pulp can be increased considerably in a sulfate pulping process if the wood is subjected to pretreatment with hydrogen sulfide gas prior to alkaline digestion with sodium hydroxide in the presence of sodium sulfide.

Vinje and Worster, U.S. Pat. No. 3,520,773, patented July 14, 1970, propose a modification of this process by carrying out the pretreatment in the presence of an alkaline buffer solution.

Here, also, however, the preparation and handling of toxic hydrogen sulfide gas under pressure, and its introduction into the pulping system, pose a considerable safety hazard, and consequently these processes have not been applied commercially, either.

Procter, Styan and Vinje, U.S. Pat. No. 3,841,962, patented Oct. 15, 1974, propose the preparation of hydrogen sulfide during the pretreatment by reaction of a liquid having a high sulfidity, such as a liquid containing sodium sulfide, with an excess of gaseous carbon dioxide. Unless the carbon dioxide is pure, rather high pressures in the digester result, in order to achieve the necessary partial pressure of hydrogen sulfide, and operation at high pressures of course increases the risk of escape of hydrogen sulfide from the system. Moreover, this requires the preparation of carbon dioxide, and the production of carbon dioxide, particularly pure carbon dioxide, is rather expensive.

In accordance with the invention, the difficulties in handling hydrogen sulfide at high pressures are avoided by generating hydrogen sulfide in situ in an alkaline pulping liquor containing sodium sulfide during a first pulping stage. Since hydrogen sulfide is generated in situ, no carbon dioxide is required, and neither are high partial pressures of hydrogen sulfide generated in pulping system. If more hydrogen sulfide is generated than is consumed in the pulping reaction in the first pulping stage, the excess can be withdrawn and utilized elsewhere as a source of either hydrogen sulfide or of sulfur. Introduction of this hydrogen sulfide in white liquor or causticized liquor reduces the requirement for causticized liquor in conventional sulfate pulping.

The generation of hydrogen sulfide in situ in the pulping liquor proceeds without the addition of carbon dioxide. Instead, hydrogen sulfide is formed in reactions between the sodium sulfide present in the pulping liquor and organic acids liberated from the wood in the first pulping stage. Consequently, the first stage of the pulping process of the invention is operated under conditions such that a large amount of alkali is consumed, and a high proportion of organic acids are liberated, for this purpose.

The hardwood pulping process in accordance with the invention is carried out in two pulping stages, and the partially pulped wood proceeds directly from the first stage to the second stage, desirably even without an intermediate washing or defibration step. In the first pulping stage, the hardwood material in particulate form is pulped with an alkaline aqueous pulping liquor containing sodium sulfide at a temperature within the range from about 110° to about 170° C, preferably from about 120° to about 150° C, liberating organic acids from the wood and generating hydrogen sulfide by reaction between sodium sulfide and such organic acids. In the second pulping stage, the resulting partially pulped hardwood material is pulped with an alkaline pulping liquor containing sodium hydroxide and sodium sulfide at a temperature within the range from about 145° to about 190° C, until a cellulose pulp is obtained.

The pulping process of the invention is applicable to any kind of hardwood. Soft wood such as spruce, fir, pine, cedar, juniper and hemlock cannot be pulped satisfactorily using this process. Exemplary hardwoods which can be pulped include birch, beech, poplar, cherry, sycamore, hickory, ash, oak, chestnut, aspen, maple, alder and eucalyptus.

The hardwood should be in particulate form. Hardwood chips having dimensions that are conventionally employed in the sulfate process can be used. Sawdust, wood flour, slivers, splinters, wood granules and wood chunks and other types of wood fragments can also be used.

The pulping liquor supplied to the first pulping stage should have a pH within the range from about 10.5 to about 13. More hydrogen sulfide is released at the lower pH values within this range, and measures may therefore have to be taken to retain hydrogen sulfide in the system under these conditions. A pH value too far on the alkaline side may impair pulp yield.

The spent alkaline liquor from the first pulping stage can be utilized to prepare fresh pulping liquor for use in the first pulping stage with another batch of hardwood material. Thus, the spent alkaline pulping liquor can be recirculated after replenishment of the amount of sodium sulfide consumed.

Spent pulping liquor from the second pulping stage can also be used, as well as spent alkaline pulping liquors from other pulping processes, and also spent bleaching liquor from other bleaching processes, such as, for example, alkaline oxygen bleaching. The alkaline liquors from alkaline extraction of cellulose pulps can also be used to prepare the pulping liquor in the first pulping stage. If the spent liquor has too high a pH, the pH can be lowered by treatment with carbon dioxide, such as that contained in flue gases.

In a preferred embodiment, which is particularly advantageous with respect to recovery and recycling of the chemicals employed, the pulping liquor in the first pulping stage is a green liquor, of a composition corresponding to that normally obtained in a sulfate pulping process. Preferably, the green liquor is one recovered after combustion of a spent alkaline sulfate pulping liquor from a sulfate pulping process carried out at a high sulfidity, i.e. from about 30 to about 50% or of a spent liquor from a polysulfide pulping process.

Somewhat higher pulp yields are normally obtained if the pulping liquor in the first pulping stage is a green liquor which has been treated with carbon dioxide, for example flue gases, to convert the sodium carbonate present partly or completely into sodium bicarbonate before the liquor is introduced into the first pulping stage.

Substantially higher pulp yields are obtained if the pulping liquor supplied to the first pulping stage is an aqueous sodium sulfide solution. Such a solution can be obtained from a smelt produced by combustion in a reducing atmosphere of spent liquors from the process of this invention, or from a smelt produced by combustion of spent pulping liquors from sulfate pulping or sulfide pulping processes with liquors containing sodium and sulfur compounds.

To enrich the pulping liquor with sodium sulfide, the sodium sulfide can be partially dissolved or leached from the smelt, separating it from the chemicals less soluble than sodium sulfide, such as sodium carbonate, or sodium carbonate can be crystallized out from an aqueous solution obtained by partial or complete dissolution of the smelt containing sodium carbonate and sodium sulfide. Sodium chloride in the smelt can also be removed by crystallization, thereby further concentrating the solution with respect to sodium sulfide.

Sodium carbonate recovered in this way can be used for preparing bleaching liquor and liquor for alkaline extraction in connection with cellulose pulp bleaching, i.e., an alkaline extraction stage following a chlorine bleaching stage or a chlorine dioxide bleaching stage. The liquor can also be used in an oxygen alkali bleaching. The sodium carbonate solution can also be converted into a sodium hydroxide solution by causticization, and then reused as sodium hydroxide. When alkali is needed for bleaching and extraction, the recovery of sodium sulfide for pulping in the first stage of the process of the invention is particularly advantageous with respect to chemical balance.

Sodium sulfide also can be produced by other methods, for example, by absorption of hydrogen sulfide in sodium hydroxide or sodium carbonate solution.

In order to increase the sulfidity, and aid in the expulsion of hydrogen sulfide in the first pulping stage of the invention, waste sulfuric acid from the manufacture of chlorine dioxide, from a chlorine drying step, from rosin manufacture, or from other sources, can advantageously be included as a component in preparing the pulping liquor used in the first pulping stage, both in the case where the chemicals recovery system is combined with chemicals recovery from other processes, and where the chemicals recovery system in the present invention is restricted to the process of the invention only.

The hardwood: pulping liquor ratio in the first pulping stage can be widely varied. A suggested proportion is within the range from about 1 part hardwood to about 5 parts liquor, to about 1 part hardwood to about 1 part liquor.

The hardwood particles can be completely or only partly immersed in the pulping liquor; the pulping liquor can also be merely sprayed over a bed of the hardwood particles, which are not immersed in liquor at all. In a continuous process the particulate hardwood material can be held in a stationary bed, with the pulping liquor circulated through it, or the particulate hardwood material can be passed counter-currently to a flow of pulping liquor. In a batch process, the pulping liquor and particulate hardwood material would be held in a digester and the pulping liquor circulated through the bed by spraying it over the bed, and recirculating the liquor from the bottom of the vessel after it has percolated through the bed.

It is also possible to impregnate the particulate hardwood material with an excess of pulping liquor, which is then drained off before or after the pulping temperature has been reached. The pulping liquor that is removed can be recycled for impregnation of another batch of hardwood particles.

The pulping is carried out by bringing the particulate hardwood material into contact with the pulping liquor and then gradually increasing the temperature, at a rate from 0.25° to 5° C per minute until the desired pulping temperature in the stated range of from about 110° to about 170° C is reached. If a high pulp yield is desired, it is generally desirable that the pulping temperature in the first pulping stage be within the range from about 120° to about 150° C.

As in other pulping processes, the rate of reaction increases with the temperature. The higher the temperature, the less time required for the pulping reactions to take place. Consequently, the reaction temperature and the residence time are chosen to give the desired consumption of titratable alkali in the course of the first pulping stage.

The time required depends also on the type of hardwood, and the size of the hardwood particles. For thin chips of some hardwood types, the pulping in the first pulping stage can be complete in as little as from 2 to 10 minutes at the pulping temperature. However, in most cases, the pulping time will be within the range from about 30 minutes to about 2 hours, although pulping times as much as 4 hours and higher can be used, especially if the pulping temperature is in the lower portion of the range.

For optimum pulp yield, pulp quality, and a minimum requirement for causticized liquor or white liquor in the process of the invention, it is important that the first pulping stage consume a considerable amount of alkali in chemical reactions with the wood, so as to form a large proportion of soluble organic acids in the pulping liquor, for reaction with sodium sulfide. These acids are those commonly formed by hydrolysis of the lignocellulosic material by alkali and represents the alkali- or water-soluble degradation products of polysaccharides which are dissolved in such liquors. The chemical nature of these degradation products is complex, and they have not been fully identified. However, it is known that acetic acid, saccharinic acid, formic acid, lactic acid, dihydroxybutyric acids, and deoxyaldonic acid are present in such liquors, and that other hydroxy acids are also present. The presence of $C_6$-isosaccharinic and $C_6$-metasaccharinic acids has been demonstrated, as well as $C_5$-isosaccharinic acid and $C_4$- and $C_5$-metasaccharinic acids, and aldaric, malic and oxalic acids. Glycolic acid and lactic acid are also probable degradation products derived from the hemicelluloses, together with beta-gamma-dihydroxy butyric acid. These acids are converted into sodium salts and thereby consume sodium sulfide, liberating hydrogen sulfide. The consumption of alkali in the reactions leading to acid formation is evaluated as titratable alkali. The term "titratable alkali", calculated as sodium hydroxide, as used herein refers to alkali determined by the following test procedure:

A boiling pulping liquor sample (10 g) is titrated potentiometrically in a closed vessel, excluding atmospheric oxygen, to a pH of 7 with either hydrochloric or sulfuric acid. The amount of titratable alkali thereby determined is calculated as NaOH. In the course of the titration, hydrogen sulfide is liberated, and is expelled from the sample. Consequently, one mole of sodium sulfide corresponds to two moles of the titratable alkali determined by this procedure as NaOH. If sodium carbonate or sodium bicarbonate is present (as may frequently be the case) carbon dioxide is liberated, and this is also expelled in the course of the titration, so that the sodium of these compounds is also determined as titratable alkali, NaOH.

The consumption of alkali determined as titratable alkali in the first pulping stage should normally be at least 3% based on the dry weight of the wood. At a high temperature and a high proportion of titratable alkali NaOH it is possible to reach an alkali consumption of 15% and more, which may be advantageous in the handling of chemicals and the recovery of hydrogen sulfide from the process for use in another pulping process. However, for a good cellulose pulp yield, it is normally desirable to carry out the first pulping stage so that the consumption of titratable alkali NaOH is within the range from about 5 to about 12%, and preferably from about 10 to about 12%, particularly if the need for hydrogen sulfide elsewhere in the pulping process is great, or the supply of causticized liquor for the second pulping stage is limited.

If it is desired to obtain both a good cellulose pulp yield and good cellulose pulp quality, the consumption of titratable alkali should be within the range from about 6 to about 10% based on the dry weight of the wood.

There will be some variations in these amounts, based on the kind of hardwood, and the pulping conditions, which therefore have to be determined according to experience with the type of wood concerned. It is of course apparent that the pulp quality, pulp yield and chemical balance may vary according to local conditions within the particular pulping system in which the process is applied, and the consumption of titratable alkali NaOH should therefore be controlled and adjusted with regard to these parameters, including the wood type.

The first pulping stage can be carried out in such a way that the titratable alkali present is completely consumed. However, normally it is desirable that the spent pulping liquor from the first pulping stage contain some residual alkali, usually an amount within the range from about 1 to about 20 g titratable alkali per liter of spent liquor.

In carrying out the first pulping stage of the invention the yield is normally held within the range from about 75% to about 92% based on the dry weight of the hardwood charged. In determining the yield, the amount of sulfur bound to the wood, normally about 0.5 to about 1.5% based on the dry weight of the wood, is subtracted. It is generally preferred to carry out the first pulping stage to a cellulose pulp yield within the range from 82 to 90%.

Depending upon the desired pulp quality and the limitations of the available equipment, the pulping conditions during the first pulping stage are so controlled that a partial pressure within the range from about 0.1 to about 2.0 MPa with respect to hydrogen sulfide is maintained. Normally, it is satisfactory if hydrogen sulfide partial pressure is held within the range from 0.3 to 1.0 MPa, under which conditions an improved yield is obtained, as compared to a normal sulfate pulping process.

Hydrogen sulfide, if present in excess, can advantageously be withdrawn from the first pulping stage, whether the stage is carried out batchwise or continuously. It is not necessary to recycle gaseous hydrogen sulfide to the first pulping stage, but recycling can be utilized, especially if it is desired to carry out the pulping stage so that the wood has a high sulfur content, for example, 1% or more.

If there is no reason to withdraw hydrogen sulfide and use it elsewhere, the hydrogen sulfide may advantageously be allowed to remain with the pulping liquor and the partially pulped hardwood particles; it can then be utilized in the second pulping stage. The second pulping stage is carried out at a higher pH than the first pulping stage, within the range from about 12.5 to about 14, under which conditions the hydrogen sulfide dissolves in the pulping liquor, and increases the sulfidity thereof. A high sulfidity in the second pulping stage promotes the dissolution of lignin, and thus contributes to a more selective lignin dissolution from the pulp.

If hydrogen sulfide is withdrawn from the first pulping stage, it should not be withdrawn until very late in the stage, i.e., when it is over 75% complete, or at the end of the stage. When the pulping process is carried out continuously, withdrawal of hydrogen sulfide is controlled to maintain a partial pressure of hydrogen sulfide in the first pulping stage within the stated range.

The hdyrogen sulfide that is withdrawn can be used in any desired process. It can, for example, be used to prepare sodium polysulfide for a polysulfide pulping liquor.

In a preferred embodiment, the hydrogen sulfide is oxidized to form elemental sulfur, as in the Claus process. This sulfur can then be used to prepare polysulfide pulping liquor by dissolution in an alkaline pulping liquor containing sodium hydroxide and/or sodium sulfide. This polysulfide pulping liquor can be used as the pulping liquor in the second pulping stage of the invention.

It can also be used elsewhere such as in a polysulfide pulping of softwood. In any case, wherever the sulfur is used, the recovery of chemicals from that procedure can be combined with the recovery of chemicals from the pulping process of the invention, so as to efficiently recover and recycle the sulfur, for optimum utilization in each process.

The partially pulped hardwood material from the first pulping stage is passed directly into the second pulping stage, without an intermediate washing, and without an intermediate defibration stage. Consequently, spent pulping liquor from the first pulping stage accompanies the partially pulped hardwood material into the second pulping stage, and any excess of such spent pulping liquor can be included as a part of the pulping liquor for the second pulping stage.

The partially pulped hardwood material can be transferred to another vessel for the second pulping stage, or the first stage pulping liquor can be withdrawn partially or entirely and replaced by second stage pulping liquor.

The second pulping stage is carried out under conditions which are conventional for a sulfate pulping process, but with the important exception that the amount of alkali is reduced considerably, in part because some of the reactions have already been carried out in the first pulping stage.

Normally, the amount of effective alkali required for the second pulping stage of the invention is less than that normally required by from about 10 to about 30%. Consequently, the charge of effective alkali in the second pulping stage is normally within the range from about 10 to about 16%, based on the dry weight of the wood, but the exact amount used will of course depend upon the type of hardwood, the desired degree of pulping, and the degree of pulping carried out in the first pulping stage, as evaluated by the determination of titratable alkali, indicated above.

A highly selective delignification is obtained in the second pulping stage if the sulfidity of the pulping liquor is high, within the range from about 30 to about 50%, but good results are also obtained at low sulfidities.

The pulping liquor for the second pulping stage can be composed wholly or in part of spent pulping liquor from the first pulping stage, the content of the alkali NaOH and sodium sulfide being replenished, as required.

Spent pulping liquor from the second pulping stage can also be used, as well as spent pulping liquors from other pulping processes, and also spent bleaching liquor from other bleaching processes, such as, for example, alkaline oxygen bleaching. The alkaline liquors from alkaline extraction of cellulose pulp can also be used to prepare the pulping liquor in the second pulping stage.

The pulping liquor supplied to the second pulping stage can have a pH within the range from about 12.5 to about 14. A pH value too far on the alkaline side may impair the pulp yield. The preferred pH range is from about 12.8 to about 14.

The hardwood:pulping liquor ratio in the second pulping stage can be widely varied. A suggested proportion is within the range from about 1 part hardwood to about 3 parts liquor, to about 1 part hardwood to about 5 parts liquor.

As in the first stage, the wood can be completely immersed in the pulping liquor; the pulping liquor can also be sprayed over a bed of the partially pulped hardwood particles.

In a continuous process, partially pulped hardwood material can be held in a moving bed, with the second stage pulping liquor circulated through it, or the partially pulped hardwood material can be passed countercurrently to a flow of pulping liquor.

In a batch process, the pulping liquor and partially pulped hardwood material would be held together in a vessel, and the pulping liquor circulated through the bed by spraying over the bed, and recirculating the liquor from the bottom of the vessel after it has percolated through the bed.

It is also possible to impregnate the partially pulped hardwood material with an excess of second stage pulping liquor, which is then drained off, before or after the pulping temperature has been reached. The pulping liquor that is removed can be recycled, for impregnation of another batch of material.

The pulping is carried out by bringing the partially pulped hardwood material into contact with the pulping liquor, and then gradually increasing the temperature at a rate, say, of 0.5° to 5° C per minute, until the pulping temperature within the range from about 145° to about 190° C is reached, from about 5° to about 75° C higher than the first stage pulping temperature. If a high pulp yield is desired, it is generally desirable that the highest temperature in the second pulping stage be within the range from about 155° to about 175° C.

The rate of reaction increases with temperature. The higher the temperature, the less time required for the pulping to be completed. Consequently, the pulping temperature and the residence time are chosen to complete the pulping to the desired Kappa number, viscosity and yield in the course of the second pulping stage.

The time required depends also on the type of hardwood, and the size of the particles. For thin chips of some hardwood types, the pulping in the second stage can be complete in as little as from 10 to 30 minutes. However, in most cases, the pulping time will be within the range from about 30 minutes to about 2 hours, although pulping times as much as 4 hours and higher can be used, especially if the pulping temperature is in the lower portion of the range.

In a preferred embodiment, which is particularly advantageous with respect to recovery and recycling of the chemicals employed, the pulping liquor in the second pulping stage is a white liquor of a composition corresponding to that normally used in a sulfate/sulfite or polysulfide pulping process. The white liquor preferably is one recovered after combustion and causticization of a spent sulfate pulping liquor from a sulfate pulping process carried out at a high sulfidity, i.e. from about 30 to about 50%, or a spent liquor from a polysulfide pulping process.

Substantially higher yields are obtained if the pulping liquor supplied to the second pulping stage is an aqueous sodium sulfide solution or an aqueous sodium hydroxide solution enriched with sodium sulfide. Such a solution can be obtained from a smelt produced by combustion in a reducing atmosphere of spent liquors from the process of this invention, or from a smelt produced by combustion of spent pulping liquors from sulfate pulping or sulfide pulping processes with liquors containing sodium and sulfur compounds.

To enrich the pulping liquor with sodium sulfide, salts less soluble than sodium sulfide in the smelt can be partially removed by partial dissolution of the smelt containing sodium carbonate and sodium sulfide, or complete dissolution followed by crystallization of sodium carbonate. Sodium chloride in the smelt can also be removed by leaching or by crystallization, thereby further concentrating the solution with respect to sodium sulfide.

Sodium sulfide also can be produced by other methods, for example, by absorption of hydrogen sulfide in sodium hydroxide.

In carrying out the second pulping stage of the invention, the yield is normally held within the range from about 50% to about 60%, based on the dry weight of the wood charged. It is generally preferred to carry out the second pulping stage to a cellulose pulp yield within the range from 53 to 58%.

After the pulping process has been completed, the pulped wood may optionally be subjected to a mechanical treatment in order to liberate the fibers. If the pulping is brief or moderate, a defibrator, or disintegrator or shredder, may be appropriate. After an extensive or more complete pulping, the wood can be defibrated by blowing off the material from the digester, or by pumping.

The cellulose pulp that is obtained in accordance with the process of the invention is of such whiteness that it can be used to advantage directly for producing tissue paper, and light cardboard. When a higher degree of brightness is desired as for fine paper, rayon and cellulose derivatives, the pulp can easily be bleached in accordance with known methods by treatment with chlorine, chlorine dioxide, chlorite, hypochlorite, peroxide, peracetate, oxygen or any combinations of these bleaching agents in one or more bleaching sequences as described in, for example, U.S. Pat. No. 3,652,388. Chlorine dioxide has been found to be a particularly suitable bleaching agent. The consumption of bleaching chemicals is generally markedly lower in bleaching pulps of the invention than when bleaching sulfate cellulose.

The chemicals used for the pulping process can be recovered after the waste liquor is burned and subsequent to causticizing the carbonate obtained when burning the liquor.

The reduced charge of alkali in the second pulping stage results in a simplified handling of chemicals and lower costs for causticization and reburning of lime sludge. As a result, and due also to the increased pulp yield, the two-step pulping process of the invention is economically advantageous.

Preferred embodiments of the pulping process of the invention and of the cellulose pulps of the invention are shown in the following Examples.

In the Examples, except for the determination of titratable alkali, which was carried out in accordance with the test procedure described above, all data was obtained using standard SCAN test procedures.

EXAMPLE 1

Birch wood chips 6 mm × 30 mm × 25 mm were charged at room temperature into an autoclave together with a pulping liquor prepared by dilution with water of green liquor containing 60.2 g/l effective alkali calculated as NaOH. The charge of titratable alkali calculated as NaOH was 10%, as determined by the test procedure described above. The wood:liquor ratio was 1:4.

The pulping was begun by increasing the temperature in the autoclave at a rate of 1.2° C per minute until 140° C was reached, and pulping at this temperature was then carried on for 2 hours. After 2 hours, the hydrogen sulfide formed was vented, and the pressure reduced to atmospheric.

The spent liquor was found to contain 0.15 mole/l of titratable alkali, corresponding to 6 g/l of sodium hydroxide. The pH of the liquor was 8.7.

The dry weight of the remaining chips was determined after washing with water, and was found to correspond to 90.8 g for 100 g of dry charged chips. After this weight is corrected for sodium and sulfur taken up by the chips, the pulp yield is found to be 89%. The liquor was drained off, and the pulping then continued in a second pulping stage using white liquor.

In the second pulping stage the wood:liquor ratio was 1:4. The charge of effective alkali as NaOH was 16%, based on the dry weight of the wood, and the sulfidity was 33%.

The partially pulped wood was brought to pulping temperature by heating the digester at a rate of 1° C per minute until 170° C was reached, and then held at this temperature for 50 minutes. Then, the digester was cooled by degassing, and the liquor was separated.

The yield of screened pulp was 55.0% based on the dry weight of the original wood, and the amount of shives was less than 0.1%. The Kappa number was 23.3, and the viscosity was 1444 $dm^3/kg$. The pH of the spent liquor was 12.9.

Control runs were made using the same birch wood, but the pulping conditions throughout were the same as in the second pulping stage, holding the wood at the 170° C temperature for 5 hours 40 minutes. Even though this digestion period was double the time required for the two-stage pulping process of the invention, the amount of shives was higher than 10%.

Accordingly, a second control run was made under the same conditions, increasing the charge of effective alkali to 18%. At this same digestion time of 5 hours 40 minutes, a pulp was obtained having a Kappa number of 23.4, practically the same Kappa number as the pulp obtained in the two-stage pulping process of the invention. The pulp yield was however only 52.0%, the amount of shives was 1%, and the viscosity was 1368 $dm^3/kg$.

Accordingly, the two-stage pulping process of the invention, as compared to this conventional sulfate pulping, gives a higher pulp yield and a reduced shives formation, as well as a higher viscosity at the same Kappa number.

EXAMPLE 2

Birch wood chips 6 mm × 30 mm × 25 mm were charged at room temperature into an autoclave together with a pulping liquor of sodium sulfide solution prepared by leaching sodium sulfide from a smelt from the chemicals recovery stage of a sulfate pulping with water at 70° C. The amount of water was so chosen that the major portion of the sodium sulfide was dissolved, while the major portion of the sodium carbonate was undissolved, and was separated by centrifuging.

The pulping was begun by heating the autoclave at a rate of 1.2° C per minute until 140° C was reached, and the temperature was then maintained at this level for 2 hours. After 2 hours, the hydrogen sulfide formed was vented, and the pressure reduced to atmospheric.

The spent liquor was found to contain 0.15 mole/l of titratable alkali, corresponding to 6 g/l of sodium hydroxide. The pH of the liquor was 8.7. The dry weight of the remaining chips was determined after washing with water, and was found to correspond to 90.8 g for 100 g of dry charged chips. After this weight is corrected for sodium and sulfur taken up by the chips, the pulp yield is found to be 89%. The liquor was drained off, and the pulping then continued in a second pulping stage, using white liquor.

In the second pulping stage, the wood:liquor ratio was 1.4. The charge of effective alkali as NaOH was 16%, based on the dry weight of the wood, and the sulfidity was 33%.

The partially pulped wood was brought to pulping temperature by heating the digester at a rate of 1° C per minute until 170° C was reached, and then held at this temperature for 50 minutes. The digester was cooled by degassing, and the liquor was separated. The yield of screened pulp was 56.1% based on the dry weight of the original wood, and the amount of shives was less than 0.1%. The Kappa number was 21.7 and the viscosity was 1450 $dm^3/kg$. The pH of the spent liquor was 12.8.

This Example shows that with the use of sodium sulfide solution in the first pulping stage, an improved yield is obtained, as compared to the use of green liquor. Although the lignin content of the pulp, as indicated by Kappa number, was lower than that of the pulp produced in Example 1, a pulp of the same viscosity was obtained.

Having regard to the foregoing disclosure, the following is claimed as the inventive and patentable embodiments thereof:

1. A process for pulping hardwood to produce cellulose pulp in good yield and of high quality, with a low requirement for causticized pulping liquor, which comprises in a first pulping stage, in the absence of added carbon dioxide, pulping the hardwood in an alkaline pulping liquor containing sodium sulfide at a pH within the range from about 10.5 to about 13 and at a temperature within the range from about 110° to about 170° C for a time sufficient to consume at least 3%, based on the dry weight of the wood, of alkali in the pulping liquor, determined as titratable alkali, in chemical reactions with the wood, thereby forming a large proportion of soluble organic acids in the pulping liquor, and generating hydrogen sulfide in situ in the alkaline pulping liquor by reaction of sodium sulfide with said organic acids; and then in a second pulping stage, following directly after the first pulping stage, continuing the pulping at a pH higher than said first stage pH, within the range from about 12.5 to about 14, and at a temperature higher than said first stage temperature, within the range from about 145° to about 190° C, in the presence of added alkaline pulping liquor comprising sodium hydroxide and sodium sulfide until cellulose pulp is produced.

2. A process according to claim 1, in which the pulping liquor in the first pulping stage is a green liquor obtained in chemicals recovery in a sulfate pulping process.

3. a process according to claim 2, in which the green liquor is one recovered after combustion of a spent alkaline sulfate pulping liquor from a sulfate pulping process carried out at a sulfidity from about 30 to about 50%.

4. A process according to claim 2, in which the green liquor is one recovered after combustion of a spent liquor from a polysulfide pulping process.

5. A process according to claim 2, in which the green liquor is treated with carbon dioxide to convert the sodium carbonate present into sodium bicarbonate before the liquor is introduced into the first pulping stage.

6. A process according to claim 1, in which the pulping liquor in the first pulping stage is an aqueous alkaline solution enriched with sodium sulfide.

7. A process according to claim 1, in which spent alkaline liquor from the first pulping stage is utilized to prepare fresh pulping liquor for use in the first pulping stage with another batch of hardwood material, after replenishment of the amount of sodium sulfide consumed.

8. A process according to claim 1, in which the consumption of titratable alkali in the first digestion pulping stage is within the range from about 3% to about 15% calculated as percent of sodium hydroxide based on the dry weight of the wood.

9. A process according to claim 1, in which the pulping liquor in the first pulping stage comprises sodium sulfide and sodium carbonate.

10. A process according to claim 1, in which the first pulping liquor is enriched in sodium sulfide obtained from a smelt produced by combustion of spent pulping liquor in a reducing atmosphere.

11. A process according to claim 10, in which the enrichment in sodium sulfide is obtained by partial dissolution of sodium sulfide from the smelt.

12. A process according to claim 10, in which the enrichment is obtained by crystallizing sodium carbonate from a solution obtained by dissolution of the smelt.

13. A process according to claim 10, in which residue remaining after separation of sodium sulfide, which is enriched in sodium carbonate, is used to prepare bleaching liquor.

14. A process according to claim 10, in which residue remaining after separation of sodium sulfide, which is enriched in sodium carbonate, is used to prepare alkaline liquor for alkaline extraction.

15. A process according to claim 1, in which the first pulping stage is carried to a yeild within the range from about 75 to about 92% based on the dry weight of the wood.

16. A process according to claim 1, in which the second pulping liquor has a pH within the range about 12.8 to about 14.

17. A process according to claim 1, in which the partial pressure of hydrogen sulfide during the first pulping stage is within the range from about 0.1 to about 2.0 MPa.

18. A process according to claim 1, in which gaseous hydrogen sulfide is withdrawn during the first pulping stage.

19. A process according to claim 18, in which withdrawn hydrogen sulfide is used to prepare sodium polysulfide for pulping liquor.

20. A process according to claim 18, in which withdrawn hydrogen sulfide is oxidized to elementary sulfur.

21. A process according to claim 1, in which the charge of effective alkali in the second pulping stage is within the range from about 10 to about 15% based on the dry weight of the wood.

22. A process according to claim 1, in which the temperature during the first pulping stage is within the range from about 120° to about 150° C.

23. A process according to claim 1, in which the temperature during the second pulping stage is within the range from about 155° to about 175° C.

* * * * *